US009647344B2

(12) United States Patent
De Lustrac et al.

(10) Patent No.: US 9,647,344 B2
(45) Date of Patent: May 9, 2017

(54) ANTENNA WITH RESONANT CAVITY

(71) Applicants: UNIVERSITE PARIS SUD, Orsay (FR); CENTRE NATIONAL DE LA RECHERCHE SCIENTIFIQUE, Paris (FR); UNIVERSITE PARIS OUEST NANTERRE LA DEFENSE, Nanterre (FR)

(72) Inventors: André De Lustrac, Sceaux (FR); Dylan Germain, Saint-Cloud (FR)

(73) Assignees: UNIVERSITE PARIS SUD, Orsay (FR); CENTRE NATIONAL DE LA RECHERCHE SCIENTIFIQUE—CNRS, Paris (FR); UNIVERSITE PARIS OUEST NANTERRE LA DEFENSE, Nanterre (FR)

( * ) Notice: Subject to any disclaimer, the term of this patent is extended or adjusted under 35 U.S.C. 154(b) by 41 days.

(21) Appl. No.: 14/411,431

(22) PCT Filed: Jun. 25, 2013

(86) PCT No.: PCT/EP2013/063215
§ 371 (c)(1),
(2) Date: Dec. 26, 2014

(87) PCT Pub. No.: WO2014/001295
PCT Pub. Date: Jan. 3, 2014

(65) Prior Publication Data

US 2016/0079678 A1 Mar. 17, 2016

(30) Foreign Application Priority Data

Jun. 28, 2012 (FR) ..... 12 01835

(51) Int. Cl.
*H01Q 13/00* (2006.01)
*H01Q 13/20* (2006.01)
(Continued)

(52) U.S. Cl.
CPC ..... *H01Q 13/20* (2013.01); *H01Q 13/206* (2013.01); *H01Q 15/00* (2013.01);
(Continued)

(58) Field of Classification Search
CPC ..... H01Q 15/00; H01Q 15/10; H01Q 13/20; H01Q 19/06
(Continued)

(56) References Cited

U.S. PATENT DOCUMENTS

2007/0159395 A1 7/2007 Sievenpiper et al.
2010/0302120 A1* 12/2010 Crouch ..... H01Q 3/46 343/837

FOREIGN PATENT DOCUMENTS

EP 2 266 166 A1 12/2010

OTHER PUBLICATIONS

Search report for related International Application No. PCT/EP2013/063215; report dated Sep. 9, 2013.
(Continued)

*Primary Examiner* — Dieu H Duong
(74) *Attorney, Agent, or Firm* — Miller, Matthias & Hull LLP

(57) ABSTRACT

The invention relates to an antenna comprising a resonant cavity deliminated by a partially reflecting surface comprising an array of resonant cells, each resonant cell forming a micro-antenna, a totally reflecting surface facing said partially reflecting surface, a radiating source disposed in said resonant cavity and configured so as to radiate a wave between the partially reflecting surface and the totally reflecting surface, said wave illuminating resonant cells of
(Continued)

the partially reflecting surface, the partially reflecting surface being curved and resonant cells being individually configured to introduced upon the passage of the incident wave radiated by the source a phase shift dependent on the curvature of the partially reflecting surface at the level of the corresponding resonant cell.

9 Claims, 4 Drawing Sheets

(51) Int. Cl.
*H01Q 15/00* (2006.01)
*H01Q 19/06* (2006.01)
*H01Q 19/185* (2006.01)
*H01Q 21/00* (2006.01)

(52) U.S. Cl.
CPC ..... *H01Q 15/0086* (2013.01); *H01Q 19/06* (2013.01); *H01Q 19/185* (2013.01); *H01Q 21/0012* (2013.01)

(58) Field of Classification Search
USPC ..... 343/909
See application file for complete search history.

(56) References Cited

OTHER PUBLICATIONS

George K. Palikaras, et al: "Advances in conformal metamaterial antennas using High Impedance (HIS) and Electromagnetic Bandgap (EBG) surfaces", Antennas and Propagation (EUCAP), Proceedings of the 5th European Conference on, IEEE, Apr. 11, 2011 (Apr. 11, 2011), pp. 3466-3469, XP031877905, ISBN: 978-1-4577-0250-1.

Ourir A et al: "Phase-varying metamaterial for compact steerable directive antennas", Electronics Letters, IEE Stevennage, GB, vol. 43, No. 9, Apr. 26, 2007 (Apr. 26, 2007), pp. 493-494, XP006028707, ISSN: 0013-5194, DOI: 10.1049/EL:20070298.

* cited by examiner

ANTENNA WITH RESONANT CAVITY

CROSS-REFERENCE TO RELATED APPLICATION

This Application is a 35 USC §371 US National Stage filing of International Application No. PCT/EP2013/063215 filed on Jun. 25, 2013, and claims priority under the Paris Convention to French Patent Application No. 12 01835 filed on Jun. 28, 2012

FIELD OF THE DISCLOSURE

This invention relates to an antenna, in particular an antenna with a cavity.

BACKGROUND OF THE DISCLOSURE

Document EP 2 266 166 describes an antenna with a cavity, with the cavity delimited by a partially reflecting flat surface facing a totally reflecting flat surface.

The partially reflecting flat surface is constituted of an array of resonant cells forming micro-antennas. The phase of the micro-antennas is controlled by using varactor diodes. It is as such possible to control the de-aiming of the antenna and its emitting frequency.

However, due to the dimensions of the partially and totally reflecting flat surfaces, this antenna cannot be integrated in all systems, in particular into the fairings of vehicles.

SUMMARY OF THE DISCLOSURE

There is therefore a need for shaped directional antennas that can be integrated into all types of systems. This invention improves the situation.

To this effect, the invention proposes an antenna comprising:

a resonant cavity delimited by:

- a partially reflecting surface comprising an array of resonant cells, with each resonant cell forming a micro-antenna,
- a totally reflecting surface facing the partially reflecting surface, a radiating source arranged in the resonant cavity and configured so as to radiate a wave between the partially reflecting surface and the totally reflecting surface, with the wave illuminating resonant cells of the partially reflecting surface.

The partially reflecting surface is curved and resonant cells are individually configured so as to introduce upon the passage of the incident wave radiated by the source a phase shift dependant on the curvature of the partially reflecting surface at the level of the corresponding resonant cell.

Embodiments of the invention as such make it possible to obtain a directional radiation while still improving the integration of the antenna into any system.

Each resonant cell can be configured so as to introduce on an incident wave a phase shift dependent on the curvature of the partially reflecting surface at the level of the resonant cell, in such a way that the array of resonant cells behaves as an array of antennas distributed over a predefined different surface.

The partially reflecting surface can comprise:

an inductive grid comprising a set of metal zones separated by dielectric zones, a capacitive grid comprising a set of metal zones separated by dielectric zones.

The inductive grid and the capacitive grid are then superimposed in such a way as to form the array of resonant cells, a resonant cell comprising an inductor and a capacitor in parallel.

The metal zones of the inductive grid and of the capacitive grid can be arranged according to parallel directions.

The phase shift introduced on the incident wave by a resonant cell can be adjusted by modifying the capacitance of the capacitive grid at the level of the resonant cell and/or by modifying the inductance of the inductive grid at the level of the resonant cell.

Two adjacent electrical contacts of the capacitive grid can furthermore be electrically connected by a variable-capacity diode, with the polarisation voltage of the variable-capacity diode being regulated in order to adjust the phase shift introduced on the incident wave by the corresponding resonant cell.

The inductive grid and the capacitive grid can be carried out by two grids with metal tracks, etched respectively on the two faces of a dielectric substrate.

Each resonant cell can furthermore be configured so as to introduce on an incident wave a phase shift defined in order to obtain by interference between the waves passing through the resonant cells a global directional radiation according to a predetermined direction of de-aiming.

The invention also proposes a partially reflecting surface comprising an array of resonant cells, with each resonant cell forming a micro-antenna, with the partially reflecting surface being curved and resonant cells being individually configured so as to introduce on an incident wave a phase shift dependent on the curvature of the partially reflecting surface at the level of the corresponding resonant cell.

BRIEF DESCRIPTION OF THE DRAWINGS

Other characteristics and advantages of the invention shall further appear when reading the following description. The latter is purely for the purposes of illustration and must be read with regards to the annexed drawings wherein.

DETAILED DESCRIPTION OF THE DISCLOSURE

Figure 1:
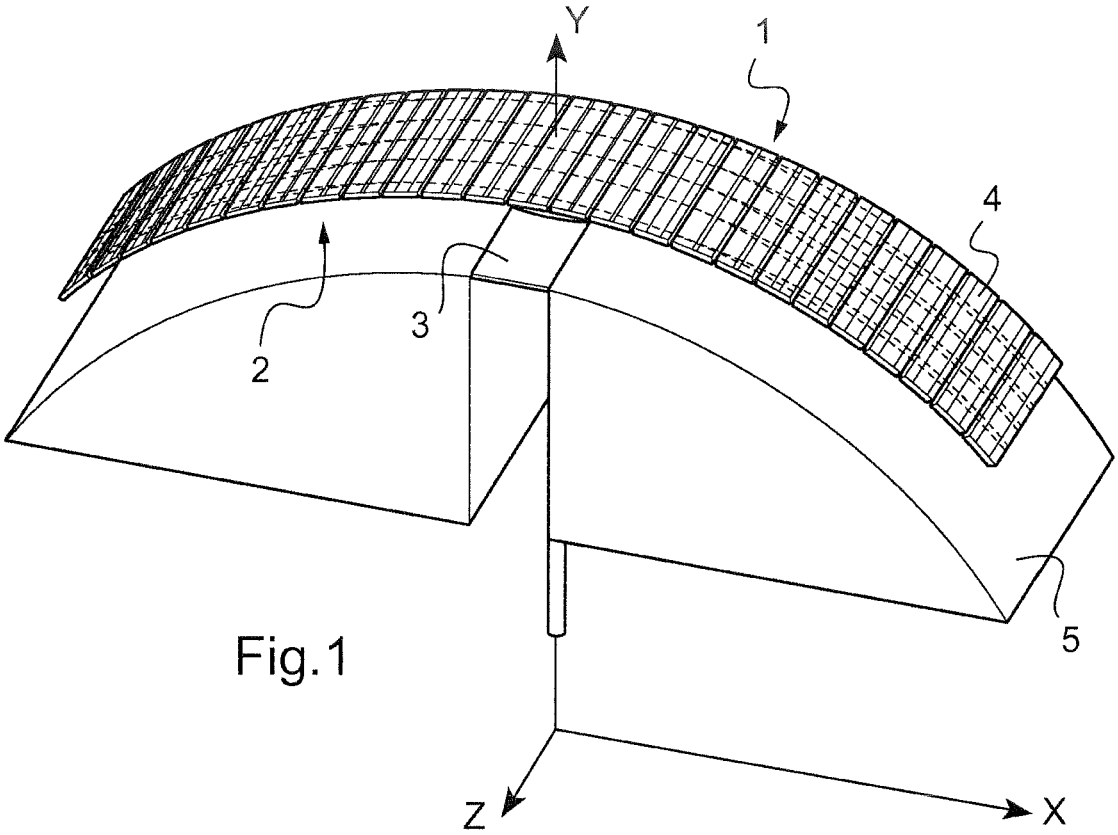
FIG. 1 is a block diagram showing an antenna according to an embodiment of the invention.

FIG. 1 shows an antenna 1 comprising a resonant cavity 2, a radiating source 3, a partially reflecting surface 4 and a totally reflecting surface 5.

The totally reflecting surface 5 is for example carried out by arranging a metal plate on a dielectric element.

The partially reflecting surface 4 is carried out by using a variable phase metal composite material. The partially reflecting surface 4 comprises an array of resonant cells $Cr_i$, with each resonant cell $Cr_i$ forming a micro-antenna or elementary antenna.

The partially reflecting surface 4 is curved. In the embodiment shown in FIG. 1, the surface 4 is cylindrical. Alternatively, the surface 4 can have any curvature. The curvature of the surface 4 corresponds to the curvature of the system, for example to the curvature of the fairing of the vehicle (train, aircraft, or other), wherein the antenna 1 must be integrated.

The partially reflecting surface 4 comprises an inductive grid GL comprising a set of metal zones separated by dielectric zones. The partially reflecting surface 4 also comprises a capacitive grid GC comprising a set of metal zones separated by dielectric zones.

The inductive grid GL and the capacitive grid GC are superimposed in such a way that the grids GL and GC are arranged in parallel to one another, with the metal zones of the inductive grid GL and of the capacitive grid GC being arranged according to substantially orthogonal directions.

The partially reflecting surface 4 can be carried out by two grids of metal tracks, etched respectively on the two faces of a dielectric substrate 6. Such an arrangement makes it possible to reduce the cost of manufacture. As the tracks of each grid are perpendicular, one will play the role of a capacitive grid GC and the other will play the role of an inductive grid GL according to the polarisation of the electric field E.

A resonant cell $Cr_i$ is as such a cell of the resonant type LC comprising an inductor L and a capacitor C in parallel. A resonant cell $Cr_i$ has a small size in view of the operating wavelength λ of the antenna 1.

Figure 2A:
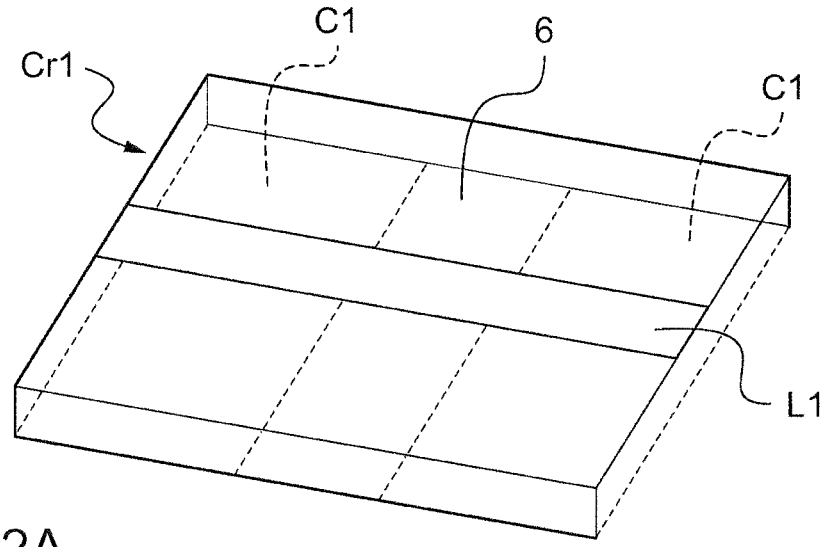
FIGS. 2A to 2C show examples of resonant cells of a partially reflecting surface of the antenna of FIG. 1.
Figure 2B:
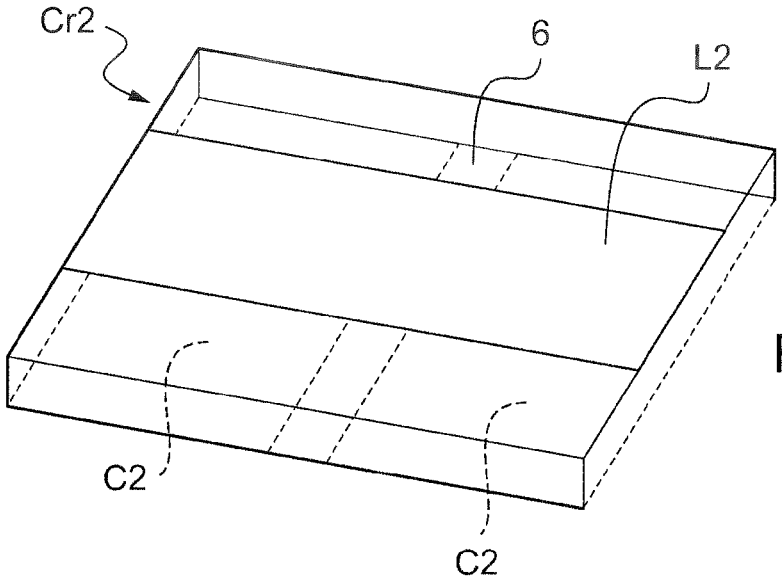
Figure 2C:
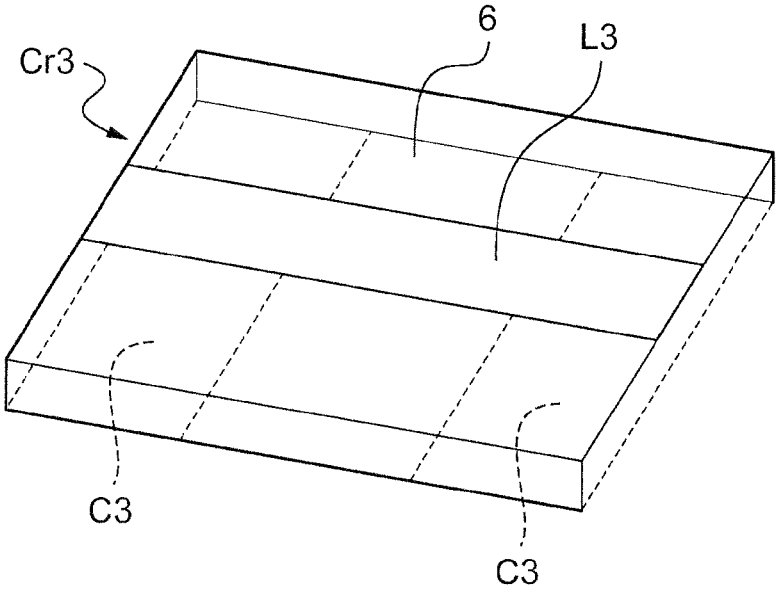
Figure 3:
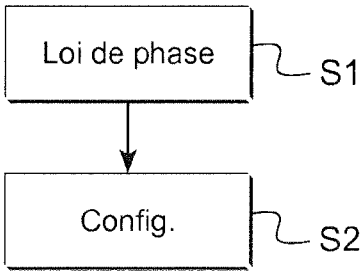
FIG. 3 is a flow chart showing the steps of a method for configuring resonant cells according to an embodiment of the invention.

FIGS. 2A to 2C show examples of resonant cells $Cr_i$. The cellule $Cr_1$ comprises a capacitor $C_1$ and an inductor $L_1$, arranged on either side of the dielectric substrate 6. The cellule $Cr_2$ comprises a capacitor $C_2$ and an inductor $L_2$, arranged on either side of the dielectric substrate 6. The cellule $Cr_3$ comprises a capacitor $C_3$ and an inductor $L_3$, arranged on either side of the dielectric substrate 6.

The cavity 2 is a cavity of the Fabry-Pérot type. The partially reflecting surface 4 and the totally reflecting surface 5, which delimit the cavity 2, are separated by a distance h forming a reference dimension of the cavity 2.

This reference dimension h satisfies the relationship:

$$h = \frac{\lambda}{4\pi}(\Phi_4 + \Phi_5) \pm N\frac{\lambda}{2},$$

where

λ designates the wavelength,

N designates the resonant mode of the cavity 2, $\Phi_4$ designates the phase shift to the reflection introduced on an incident wave by the partially reflecting surface 4, and $\Phi_5$ designates the phase shift introduced on a wave by the totally reflecting surface 5.

The use of a partially reflecting surface 4 comprising adjustable-phase resonant cells makes it possible to lift the restriction on the half-wavelength thickness (λ/2) generally imposed for a cavity of the Fabry-Pérot type. The reference dimension h can as such be chosen such that $h \ll \lambda/2$. It is then possible to carry out ultra-compact antennas, for example of about 0.5 mm for a frequency of 8 GHz.

The radiating source 3 is arranged in the resonant cavity 2, in the vicinity of the totally reflecting surface 5. The radiating source 3 is for example a patch antenna or a dipole.

The radiating source 3 is configured to radiate a wave with a predefined frequency, between the partially reflecting surface 4 and the totally reflecting surface 5. The wave as such illuminates the resonant cells $Cr_i$. Preferably, the source 3 and the partially reflecting surface 4 are arranged in such a way that all of the cells $Cr_i$ are illuminated by successive reflections on the walls of the cavity.

The resonant cells $Cr_i$ are individually configured so as to introduce upon the passage of an incident wave radiated by the source 3 a phase shift $\Phi_{4,Cri}$ dependent on the curvature of the partially reflecting surface 4 at the level of the resonant cell $Cr_i$.

The array of resonant cells $Cr_i$ acts as such as an array of antennas distributed over a predefined different surface, called the target surface. The predefined different surface is for example a flat surface. Alternatively, the predefined surface is any surface that has a curvature different from the partially reflecting surface 4.

In reference to FIGS. 3 to 7, the steps of a method for configuring resonant cells $Cr_i$ are described hereinbelow according to an embodiment of the invention. An orthogonal marking (0,X,Y,Z) is defined.

In the step S1, a phase rule $\Phi_4(x,y,z)$ to be applied to the cells Cri is determined. The phase rule $\Phi_4(x,y,z)$ is determined by taking in particular the curvature of the partially reflecting surface 4 and the curvature of the target surface into account. For example, the target surface is a plane P.

Figure 4:
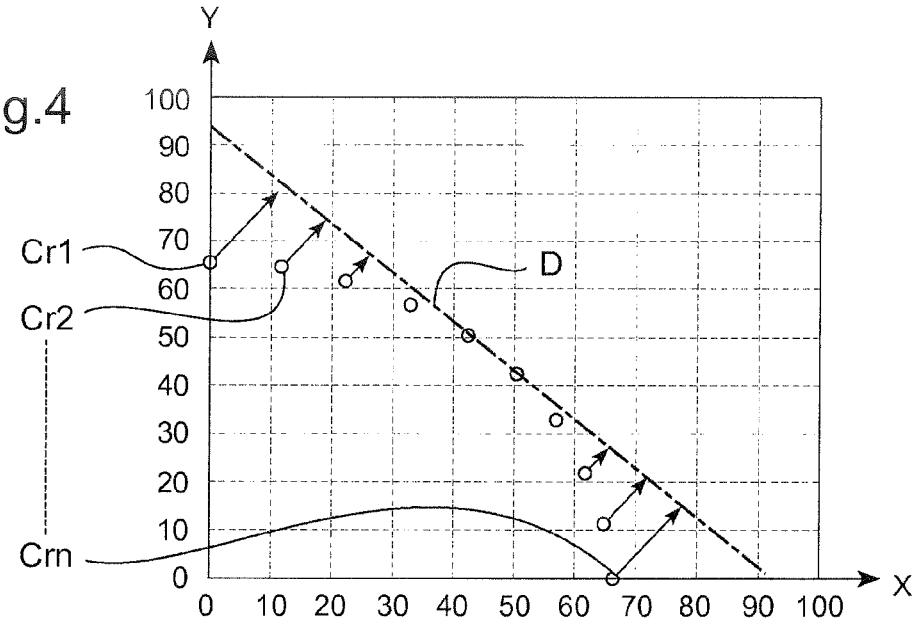
FIG. 4 is a graph showing initial positions of resonant cells in a plane.

FIG. 4 shows cells $Cr_i$ belonging to the plane $(X,Y,Z_0)$. As the partially reflecting surface 4 has a symmetry according to the plane (0,Y,Z), only the cells $Cr_i$ that have positive abscissa have been shown. The plane P forming the target surface cuts the plane $(X,Y,Z_0)$ along a straight line D of equation ax+by+c=0.

The phase rule $\Phi_4(x,y,z_0)$ to be applied to the cells $Cr_i$ arranged in the plane $(X,Y,Z_0)$ can then be defined by the equation:

$$\Phi_4(x_i, y_i, z_0) = \frac{|ax_i + by_i + c|}{\sqrt{a^2 + b^2}} \times \frac{360°}{\lambda}$$

Where $x_i$ and $y_i$ designate respectively the abscissa and the ordinate of the cell $Cr_i$.

Figure 5:
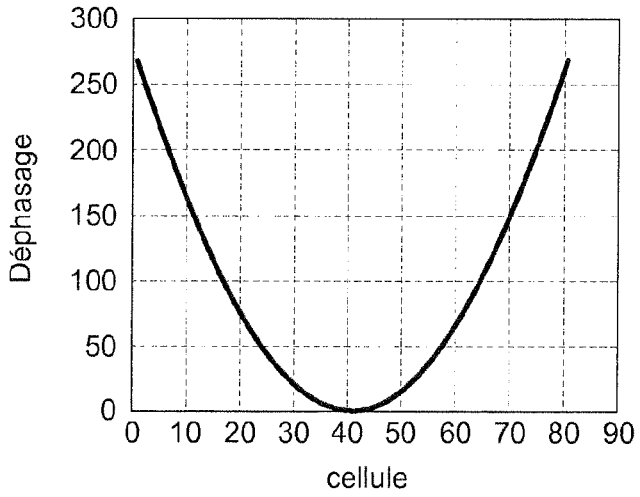
FIG. 5 is a graph showing phase shifts to be applied to each resonant cell of FIG. 4 so that the array of cells acts as a flat array of cells.

The curve of FIG. 5 shows the phase rule $\Phi_4(x,y,z_0)$ to be applied to the cells $Cr_i$ arranged in the plane $(X,Y,Z_0)$.

In addition, as the partially reflecting surface 4 has a cylindrical shape of axis Z, the phase rule $\Phi_4(x,y,z)$ does not depend on the z coordinate. The phase rule $\Phi_4(x,y,z)$ to be applied to the cells $Cr_i$ can therefore be defined by the equation:

$$\Phi_4(x_i, y_i, z_i) = \frac{|ax_i + by_i + c|}{\sqrt{a^2 + b^2}} \times \frac{360°}{\lambda}$$

In the step S2, the resonant cells $Cr_i$ are individually configured so as to introduce upon the passage of an incident wave radiated by the source 3 a phase shift $\Phi_{4,Cri}=\Phi_4(x_i, y_i, z_i)$ corresponding to the phase rule determined in the step S1.

The phase shift $\Phi_{4,Cri}$ introduced on the incident wave by a resonant cell $Cr_i$ can be adjusted passively by modifying the capacitance $C_i$ and/or the inductance $L_i$ of the cellule $Cr_i$. The capacitance $C_i$ of a cell $Cr_i$ can be modified by increasing or decreasing the width of the metal zones and/or the width of the dielectric between two adjacent metal zones. Similarly, the inductance $L_i$ of a cell $Cr_i$ can be modified by increasing or decreasing the width of the metal zone and/or the width of the dielectric between the metal zone and an adjacent metal zone.

Figure 6:
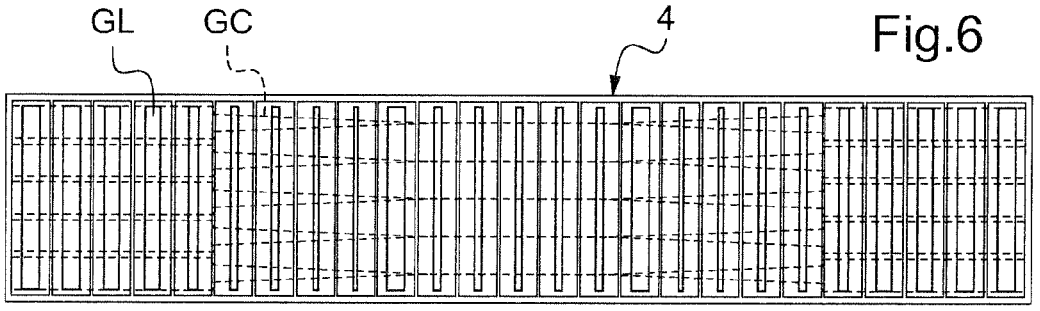
FIG. 6 is a block diagram showing the partially reflecting surface after the configuration of the resonant cells according to an embodiment of the invention.

FIG. 6 shows a top view of a partially reflecting surface 4 corresponding to the phase rule determined in the step S1. Note that a given phase shift can be obtained by several different combinations of capacitance and inductance values.

Figure 7:
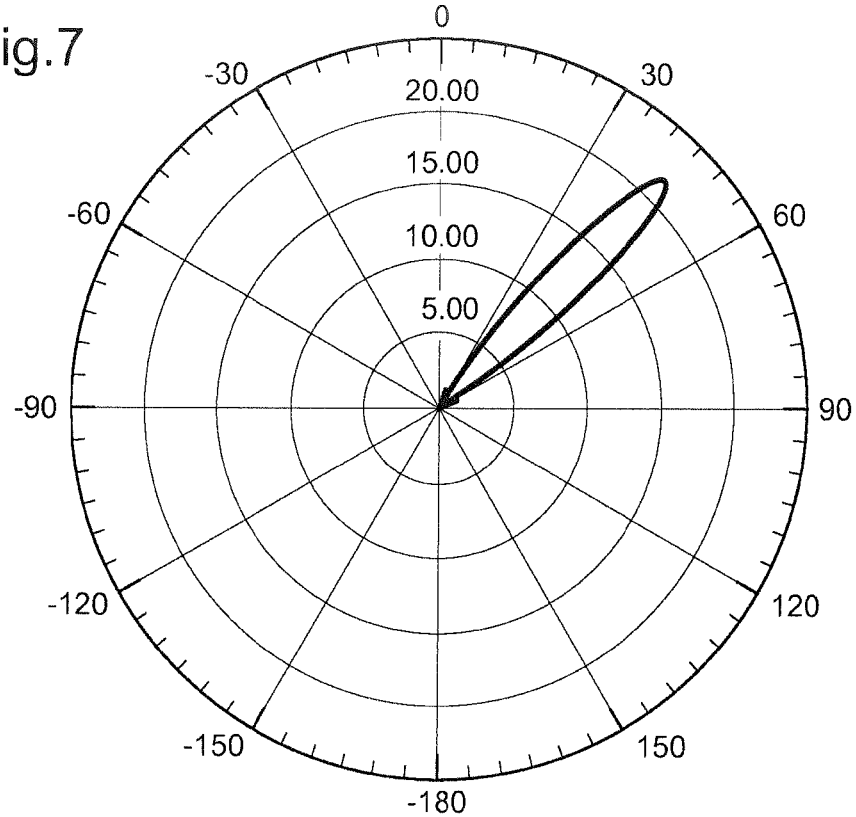
FIG. 7 is a radiation pattern of the antenna obtained by implementing the configuration method.

FIG. 7 shows the radiation pattern of the antenna 1 obtained by implementing the method described hereinabove. The method as such makes it possible to obtain a directional radiation using a set of micro-antennas forming initially a surface of any curvature.

According to an embodiment of the invention, the phase rule $\Phi_4(x,y,z)$ is furthermore determined by taking a desired de-aiming angle into account. The phase rule is then determined so that the resonant cells $Cr_i$ introduce on an incident wave a phase shift that makes it possible to obtain, by interference between the waves passing through the resonant cells $Cr_i$, a global directional radiation according to the predetermined de-aiming direction.

In this embodiment, the phase rule $\Phi_4(x,y,z)$ determined in the step S1 takes the desired de-aiming angle into account.

The de-aiming angle of the antenna 1 can be controlled passively by modifying the capacitors C and/or the inductors L of the cells $Cr_i$.

The de-aiming angle of the antenna 1 can furthermore be controlled actively by using variable-capacity diodes (varactors).

Figure 8:
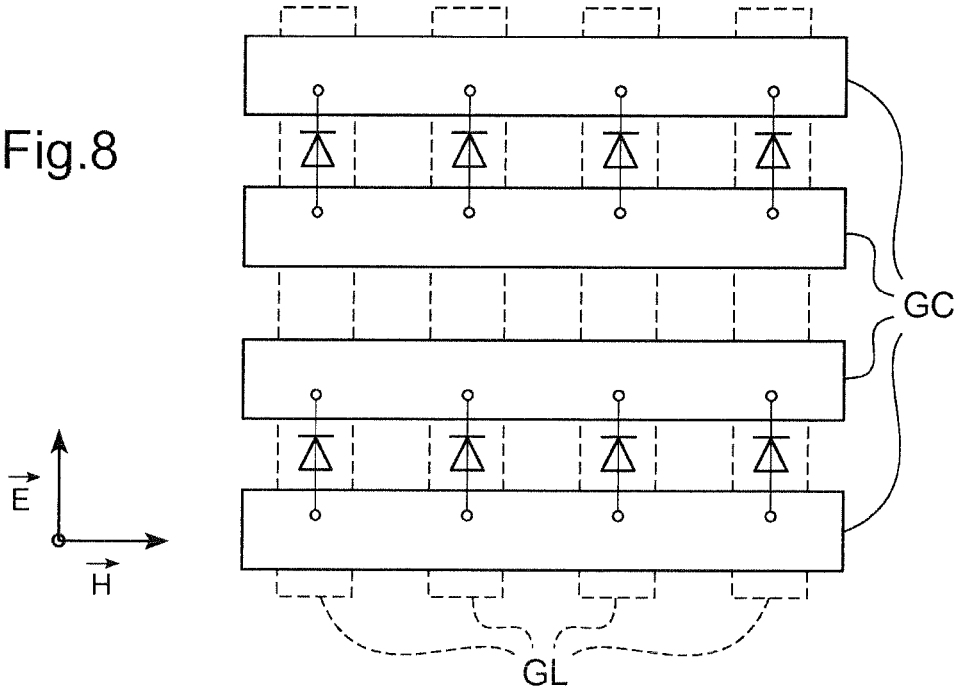
FIG. 8 is a block diagram showing the partially reflecting surface according to another embodiment of the invention allowing for a dynamic control of the antenna.

FIG. 8 shows an embodiment for active control wherein two adjacent electrical contacts of the capacitive grid GC are electrically connected by a variable-capacity diode (varactor).

The phase shift introduced on the incident wave by a resonant cell $Cr_i$ can then be adjusted dynamically by modifying the polarisation voltage of the variable-capacity diode, for example as described in document EP 2 266 166.

The de-aiming angle of the antenna 1 can as such be controlled dynamically, and in particular be modified over the course of time.

Of course, this invention is not limited to the embodiments described hereinabove by way of examples; it extends to other alternatives.

The invention claimed is:

1. Antenna (1) comprising:

a resonant cavity (2) delimited by:

a partially reflecting surface (4) comprising an array of resonant cells (Cri), with each resonant cell forming a micro-antenna, a totally reflecting surface (5) facing said partially reflecting surface, a radiating source (3) arranged in said resonant cavity and configured so as to radiate a wave between the partially reflecting surface and the totally reflecting surface, said wave illuminating resonant cells of the partially reflecting surface, with the partially reflecting surface being curved and resonant cells being individually configured so as to introduce upon the passage of the incident wave radiated by the source a phase shift dependent on the curvature of the partially reflecting surface at the level of the corresponding resonant cell.

2. The antenna according to claim 1, wherein each resonant cell (Cr;) is configured so as to introduce on an incident wave a phase shift according to the curvature of the partially reflecting surface at the level of said resonant cell, in such a way that the array of resonant cells acts as an array of antennas distributed over a predefined different surface.

3. The antenna according to claim 1, wherein the partially reflecting surface comprises:

an inductive grid (GL) comprising a set of metal zones separated by dielectric zones, a capacitive grid (GC) comprising a set of metal zones separated by dielectric zones, with the inductive grid and the capacitive grid being superimposed in such form said array of resonant cells (Cp), with a resonant cell comprising an inductor and a capacitor in parallel.

4. The antenna according to claim 3, wherein the metal zones of the inductive grid (GL) and of the capacitive grid (GC) are arranged according to parallel directions.

5. The antenna according to claim 3, wherein the phase shift introduced on the incident wave by a resonant cell (Cr,) is adjusted by modifying the capacitance of the capacitive grid (GC) at the level of said resonant cell.

6. The antenna according to claim 3, wherein the phase shift introduced on the incident wave by a resonant cell (Cr;) is adjusted by modifying the induction of the inductive grid (GL) at the level of said resonant cell.

7. The antenna according to claim 3, wherein two adjacent electrical contacts of the capacitive grid (GC) are electrically connected by a variable-capacity diode, with the polarisation voltage of the variable-capacity diode being regulated in order to adjust the phase shift introduced on the incident cell by the corresponding resonant cell (Cr;).

8. The antenna according to claim 3, wherein the inductive grid (GL) and the capacitive grid (GC) are carried out by two grids with metal tracks, etched respectively on the two faces of a dielectric substrate.

9. The antenna according to claim 1, wherein each resonant cell (Cr;) is furthermore configured so as to introduce on an incident wave a phase shift defined in order to obtain by interference between the waves passing through the resonant cells a global directional radiation according to a predetermined de-aiming direction.

* * * * *